United States Patent [19]

Lennon, et al.

[11] Patent Number: 4,924,784

[45] Date of Patent: May 15, 1990

[54] FIRING OF PULVERIZED SOLVENT REFINED COAL

[75] Inventors: Dennis R. Lennon, Allentown, Pa.; Richard B. Snedden, McKeesport, Pa.; Edward P. Foster, Macungie, Pa.; George T. Bellas, Library, all of Pa.

[73] Assignee: International Coal Refining Company, Allentown, Pa.

[21] Appl. No.: 584,046

[22] Filed: Feb. 27, 1984

[51] Int. Cl.[5] ..... F23D 1/02

[52] U.S. Cl. ..... 110/261; 110/106; 110/262; 110/264; 110/265

[58] Field of Search ..... 110/260, 261, 263, 264, 110/265, 347

[56] References Cited

U.S. PATENT DOCUMENTS

| | | | |
|---|---|---|---|
| 1,726,870 | 9/1929 | Trent | 110/261 |
| 2,096,765 | 10/1937 | Saha | 110/264 |
| 2,738,776 | 3/1956 | Burg | 110/264 |
| 2,744,742 | 5/1956 | Lord | 110/260 |
| 3,299,841 | 1/1967 | Hemker et al. | 110/262 |
| 3,589,315 | 6/1971 | Hart | 110/264 |
| 4,147,116 | 4/1979 | Graybill | 110/264 |
| 4,221,174 | 9/1980 | Smith et al. | 110/265 |
| 4,321,034 | 3/1982 | Taccone | 110/106 |
| 4,333,405 | 6/1982 | Michelfelder et al. | 110/265 |
| 4,350,103 | 9/1982 | Poll | 110/264 |

*Primary Examiner*—Henry C. Yuen

*Attorney, Agent, or Firm*—James W. Hellwege

[57] ABSTRACT

A burner for the firing of pulverized solvent refined coal is constructed and operated such that the solvent refined coal can be fired successfully without any performance limitations and without the coking of the solvent refined coal on the burner components. The burner is provided with a tangential inlet of primary air and pulverized fuel, a vaned diffusion swirler for the mixture of primary air and fuel, a center water-cooled conical diffuser shielding the incoming fuel from the heat radiation from the flame and deflecting the primary air and fuel steam into the secondary air, and a water-cooled annulus located between the primary air and secondary air flows.

16 Claims, 2 Drawing Sheets

FIG.5
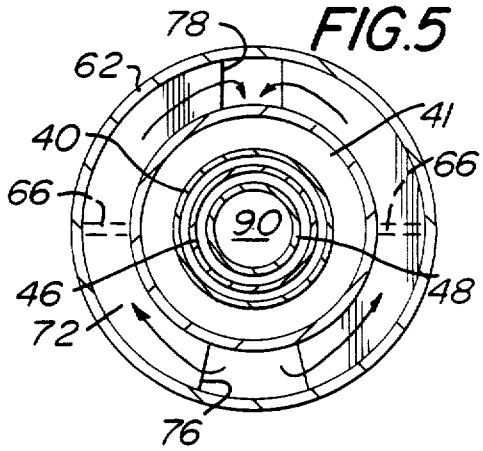
FIG.1
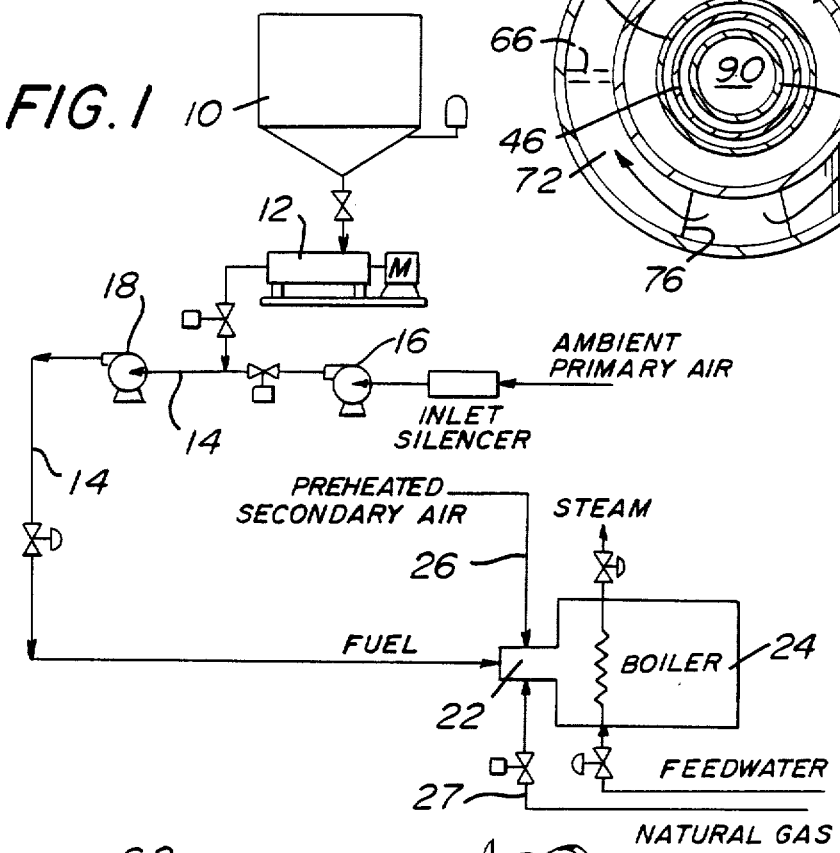
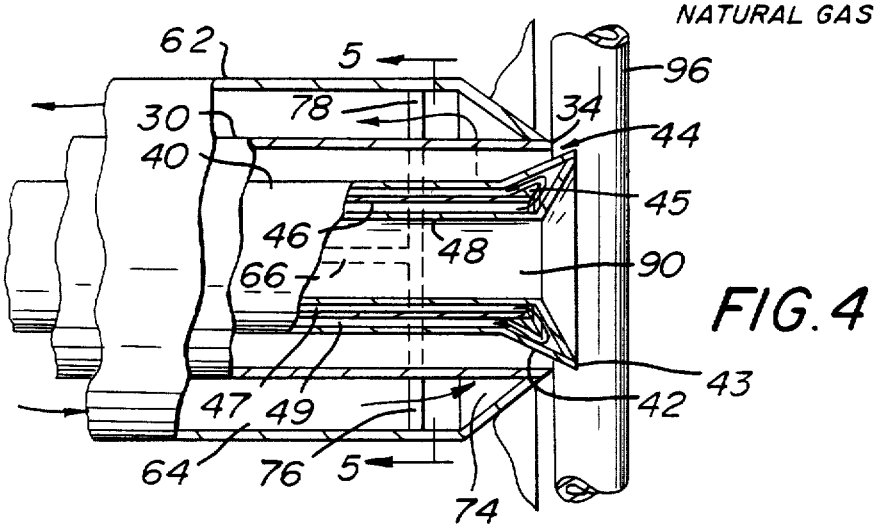
FIG.4

FIRING OF PULVERIZED SOLVENT REFINED COAL

BACKGROUND OF THE INVENTION

This invention relates generally to the art of firing pulverized solvent refined coal in a burner for a boiler or the like.

The Government of the United States of America has rights in this invention pursuant to Contract No. DE-AC05080-R03054 (as modified) awarded by the U.S. Department of Energy.

Solvent refined coal, also known as SRC-I, is a low sulfur, low ash, solid fuel produced from coal and having a composition such that it could be used as a utility boiler fuel which can be burned under environmentally acceptable conditions. Solvent refined coal is produced by the dissolution and hydrogenation of pulverized coal in a process-derived solvent. The resulting process stream is flashed to remove hydrogen and like gases, filtered or critical solvent deashed to remove undissolved coal and ash, and then fractionated to separate byproduct gases and distillable liquids, recycle process solvent, and the solvent refined coal product. The solvent refined coal yield is the hydrocarbon fraction having a boiling point substantially greater than 850° F. and generally represents 40 to 70 percent of the moisture ash free feed coal.

Testing is underway by the U.S. Department of Energy to determine the suitability of solvent refined coal as a utility boiler fuel. It would be desirable if the solvent refined coal could be used in existing coal-fired units or fuel oil-designed boilers with a minimum of retrofitting and capital cost.

As to its physical characteristics, solvent refined coal typically has a sintering temperature of 170° F., a melting point of 284° F., a specific gravity of 1.24 grams per cubic centimeter and a bulk density of 50 lbs. per cubic foot as received. Also, solvent refined coal has a heating value which is considerably higher than that of coal, namely, about 15,600 Btu/lb under dry conditions. Also, solvent refined coal has a low melting point, in the range of 280–300° F. Thus, for successful pulverization, the internal mill temperature should not exceed approximately 150° F. In addition, to avoid fouling and coking of solvent refined coal on burner surfaces, cooling of the burner has been recommended.

Furthermore, solvent refined coal is very friable and has a Hardgrove Value (a grindability index) typically greater than 170 as compared to coal which is much less than 100.

It has been found that, as compared to coal, the pulverizing of solvent refined coal results in the mill fineness increasing 20 to 30% in the fraction passing 200 mesh, in conjunction with a 25% drop in the mill power consumption.

The U.S. Department of Energy has performed some combustion demonstration development work with pulverized solvent refined coal. In addition, other combustion work with pulverized solvent refined coal has been performed.

The state of the prior art and said development work are set forth in the following publications:

1. "Combustion of Pulverized, Solvent-Refined Coal", (Authors: C. R. McCann, J. J. Demeter and D. Bienstock) presented at the Spring Meeting of the Combustion Institute's Central States Section, Apr. 5–6, 1976, at Battelle-Columbus. U.S. Energy Research and Development Administration, Pittsburgh Energy Research Center, Energy Conversion, Pittsburgh, Pennsylvania.

2. "Combustion Tests with Alternative Fuels in Oil-Designed Boilers", by Y. S. Pan, G. T. Bellas and J. I. Joubert of the Pittsburgh Energy Technology Center, U.S. Department of Energy.

3. "Combustion of Solvent-Refined Coal in a 100-HP Fire-tube Boiler", (Authors: Y. S. Pan, G. T. Bellas, D. E. Wieczenski, R. B. Snedden and J. I. Joubert of the Pittsburgh Energy Technology Center, U.S. Department of Energy; and D. R. Hart, E. P. Foster and T. G. Ingham of International Coal Refining Company) presented at the 16th Intersociety Energy Conversion Engineering Conference in Atlanta, Georgia, Aug. 14, 1981.

4. "Final Test Report on the Combustion of Solvent-Refined Coal in a 100-HP Firetube Boiler", by Y. S. Pan, D. E. Wieczenski, R. B. Snedden, G. T. Bellas, J. I. Joubert, A. R. Curio and D. J. Wildman of the Pittsburgh Energy Technology Center, U.S. Department of Energy.

5. "Compilation and Assessment of SRC Experience: Data Book" (AF-1019, Research Project 987-1, Final Report, March 1979), prepared by Bechtel National, Inc., Research and Engineering, 50 Beale Street, San Francisco, California, for Electric Power Research Institute, 3412 Hillview Avenue, Palo Alto, California.

6. "Effect of Liquefaction Processing Conditions on Combustion Characteristics of Solvent-Refined Coal" (AP-2328, Research Project 1412-9, Interim Report, March 1982), prepared by Combustion Engineering, Inc., Windsor, Connecticut, for Electric Power Research Institute, Palo Alto, California.

7. "SRC-I Combustion Test 100 H.P. Combustion Test Facility Test Report by K. E. Brown, L. A. Doppleb, R. H. Egeland, D. E. Jones, D. P. Reehl, and R. F. Ribich of Management and Technical Services Company, General Electric Company, Clairton, Pennsylvania. Contact #DEAC0278ET13011.

8. "Solvent Refined Coal Burn Test Final Report", conducted by the Research and Development Department of Southern Company Services, Incorporated, Birmingham, Alabama—July 1979.

While many of the problems encountered during the above-mentioned development work were overcome, one of the most significant limitations encountered was the performance of the burner originally designed for the firing of the pulverized solvent refined coal. The main problem with the burner is that of eliminating the fouling of those parts of the burner which are exposed to radiant heat from the boiler, which burner parts may exceed the temperature at which solvent refined coal becomes sticky resulting in the fouling and coking of these hot burner components. In order to prevent coking of the solvent refined coal on the burner components, the temperature thereof should not exceed 150° F. In conventional circular burners, the impeller which aids the mixing of the air and fuel at the burner tip is an ideal site for coking to develop and is difficult to water-cool. It has been proposed to use a dual register burner because in this type of burner design air spin vanes are provided to create adequate mixing of the fuel and air (thereby replacing the impeller) and such vanes are less vulnerable to fouling and coking in the discharge area. However, the tip of the nozzle is still subject to radiant heating and provides a potential source of coking.

The present state of the prior art is that all of the various burner designs proposed for the firing of pulverized solvent refined coal have various performance limitations.

SUMMARY OF THE INVENTION

It is the general object of this invention to provide a burner which has a design and is operated such that pulverized solvent refined coal can be fired successfully without performance limitations and without any significant coking of the solvent refined coal on the burner components.

Briefly stated, the general object of the invention is achieved by the utilization of a novel combination of burner design features and operating conditions. The burner in accordance with the invention is superior to previous burners for various reasons. Firstly, the burner permits stable combustion with a flame length short enough for a conventional fuel oil-designed boiler with a short burner-to-back wall distance. Secondly, the burner in accordance with the invention permits more complete carbon conversion efficiency in an oil-designed boiler at full load than any other prior pulverized solvent refined coal burner, the conversion efficiency being in excess of 99% carbon conversion. Thirdly, the burner in accordance with the invention permits stable operation at low excess air levels whereby a high efficiency is achieved. Fourthly, the burner in accordance with the invention operates with essentially pluggage/deposition free burner operation with a fast mix flame, which flame achieves high combustion efficiency. Fifthly, the burner design in accordance with the invention permits direct contact fuel dispensing devices (such as diffusers or deflecting cones and the like) to be placed in the burner.

The various design features of the burner in accordance with the invention resulting in the improved results are as follows:

(1) The inlet of primary air and pulverized fuel (solvent refined coal) into the burner is such that good dispersion of the fuel in the air stream is achieved. Specifically, a tangential inlet was found to be satisfactory.

(2) There is provided a vaned diffusion swirler attached to a center tube and oriented at thirty degrees from the burner axis in the direction of flow to swirl the primary air and fuel cocurrent with the primary air tangential inlet and cocurrent with the swirl of the secondary air.

(3) A center water-cooled conical diffuser is provided at the downstream end of the burner, the diffuser being constructed and arranged to shield the incoming fuel in the burner from the heat radiation from the flame and to deflect the primary air and fuel stream into the secondary air. More specifically, this conical diffuser employs a cone angle of sixty degree, although this angle could be varied to control the fuel mixing pursuant to the construction of the furnace.

(4) A water-cooled annulus is located between the primary air and the secondary air flows.

The important operating features of the novel burner means in accordance with the invention are as follows:

(1) The primary air and fuel velocity is maintained to be greater than 95 feet per second.

(2) The primary air burner port exit operating velocity was controlled to achieve the objectives of the invention.

While various of the above-described features have been used in burners, these features have not been employed in combination or have not been employed in burners for pulverized solvent refined coal in a satisfactory manner. For example, while U.S. Pat. No. 4,274,587 discloses a water-cooled annulus between the primary air and the secondary air, the design utilized is very complex as compared with arrangement pursuant to the invention. Also, the primary air velocity of 95 feet per second is much higher than the normal velocity range for any comparable burner such as the burners used for coal or the like. Moreover, this concept of increasing the speed of primary air and fuel mixture at the burner exit is unique and is believed to be contrary to the type of operation suggested by the teachings of the prior art. In this regard, conventional wisdom suggests that it is unnecessarily inefficient to operate at such high velocities and the operation at these high velocities would cause erosion problems in the burner.

BRIEF DESCRIPTION OF THE DRAWINGS

FIG. 1 is a schematic view showing a typical combustion system for the firing of solvent refined coal.

FIG. 4 is an enlarged fragmentary view of the encircled portion at the tip of the burner shown in FIG. 2.

FIG. 5 is a sectional view taken on line 5—5 of FIG. 4.

DETAILED DESCRIPTION OF THE PREFERRED EMBODIMENT

Figures 2, 3:
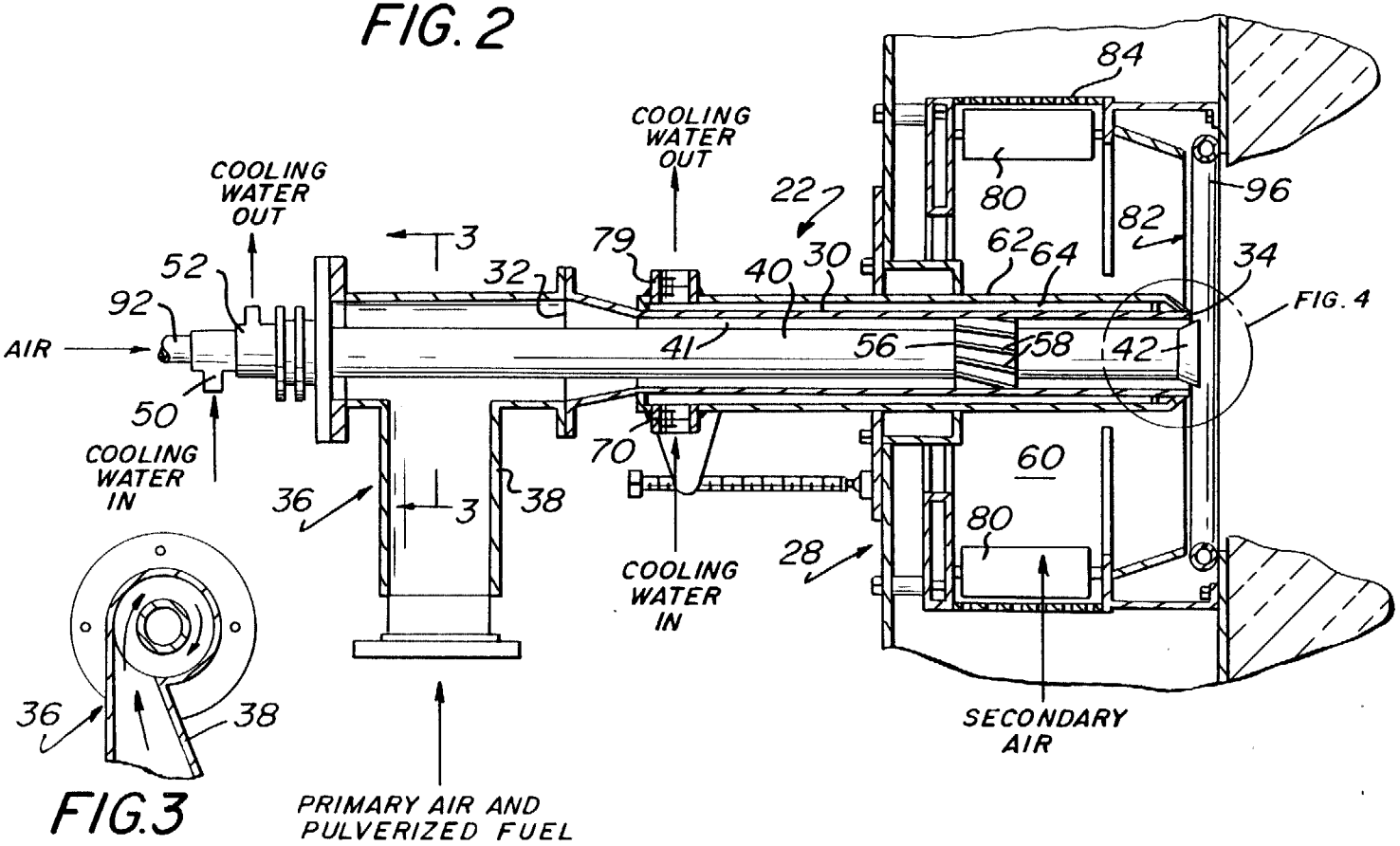
FIG. 2 is a sectional view of a burner in accordance with the invention.
FIG. 3 is a sectional view taken on line 3—3 of FIG. 2.

Referring to FIG. 1, crushed solvent refined coal (SRC) is fed from a pulverizer (such as a Mikropol ACM-10 rotating hammer mill) to a Petrocarb pulverized fuel storage and injection system (not shown) which then delivers it to a feed bin 10. The pulverized solvent refined coal is fed from feed bin 10 to a screw feeder 12 from which it passes into a dilute phase transport line 14 including blowers 16 and 18 for delivering the primary air and the SRC fuel to the burner 22 for a boiler 24. The blowers 16 and 18 in the transport line 14 are operated under pressure and flow conditions such that the transport fluid velocity through the transport line 14 is maintained to be above approximately 95 feet per second so as to prevent saltation of the pulverized solvent refined coal in said transport line. At the burner 22 the primary air-coal mixture is joined with preheated secondary air supplied through a line 26 to the burner 22, with natural gas being supplied to the burner 22 through a line 27 as shown in FIG. 1.

A burner 22 in accordance with the invention is shown in detail in FIGS. 2–5 and is mounted to extend through a windbox 28 which, as shown in FIG. 2, is mounted on the furnace wall adjacent a furnace opening as is conventional in the art. The burner 22 comprises a tube 30 extending through the windbox 28. The tube 30 has an inlet end 32 located externally of the windbox 28 and a discharge end 34 located adjacent the furnace opening. Inlet means 36 are mounted adjacent the inlet end 32 of the tube 30 and comprises a ductwork structure arranged to deliver primary air and pulverized solvent refined coal from the transport line 14 into the inlet end 32 of the tube 30 in the tangential swirling flow. The structure for achieving this flow of primary air and fuel is shown in FIGS. 2 and 3. The inlet means 36 comprises a converging duct portion 38 arranged to deliver the primary air and fuel in a path tangential to tube 30 causing a swirling flow thereof around the axis of the tube 30 as shown by the arrows in FIG. 3.

A water-cooled center diffuser 40 is mounted internally of the tube 30 to extend centrally along the axis thereof as shown in FIG. 2. Diffuser 40 is a support tube for a conical diffuser portion 42 and extends from the outside of the inlet means 36 along the axis of the tube 30 to a location inwardly of the discharge end 34 thereof. By this arrangement a single annular flow passage 41 is provided between center diffuser 40 and tube 30 for the flow of the primary air-fuel mixture from inlet means 36 to discharge end 34.

The end of diffuser 40 is provided with the conical diffuser portion 42 which is constructed and arranged for diverting the flow of the primary air-fuel mixture outwardly at an angle of about thirty degrees to the longitudinal axis of the burner tube 30. The conical portion 42 cooperates with the end of tube 30 to define an annular burner port or orifice 44 for the primary air and fuel mixture. The diameter of the conical portion of the diffuser is such that the cross-sectional area of the burner orifice is less than the cross-sectional area of the annular burner passage. The burner parts are constructed and arranged so the diameter of conical portion 42 at its tip 43 is approximately the same as the diameter of the burner tube 30 (See FIG. 4). By this arrangement, the conical portion 42 of the diffuser 40 serves to shield the discharge end 34 of the burner tube 30 from heat radiation from the flame to thereby prevent excess heating thereof and the melting of the solvent refined coal fuel at this general location. Also, the incoming fuel is shielded from radiation until it exits from the burner tip.

Means are provided for water-cooling the center diffuser 40 throughout its entire length. To this end, there is provided a water jacket comprising a pair of concentric tubes 46 and 48 internally of tube 40 forming inner and outer annular passages 47 and 49, respectively. Cooling water is delivered into the inner passage 47 by way of an inlet means 50 so that water flows from left to right as viewed in FIG. 2 along the entire length of diffuser 40. At the conical portion 42 at the end of the diffuser 40, the water flows around the cone-shaped tip 45 of the inner tube 46 and backwardly from right to left in the annular passage 49 along the length of diffuser 40 to an outlet means 52 through which the water is discharged from annular passage 49. The cooling water is pumped through the above-described water jacket provided by tubes 46 and 48 by a suitable pump (not shown) which is operated to provide a high flow velocity of the cooling water.

A vaned diffusion swirler 56 is located in the annular flow passage 41 between the center diffuser 40 and the burner tube 30. Typically, the swirler 56 is located with its front end about two burner tube diameters back from conical portion 42 and is provided with twelve vanes 58 arranged at approximately a thirty degree angle to the direction of flow. The swirler 56 is constructed and arranged to maintain the direction of the swirling action of the primary air-fuel mixture passing longitudinally through flow passage 41, this swirling action having been initiated by the tangential inlet means 36.

A water-cooled annulus is provided between the primary air-fuel mixture flow and secondary air flow supplied to the windbox chamber 60 through which the burner tube 30 extends. To this end, a tubular jacket 62 extends around the exterior of the burner tube 30 from a location extending back from the discharge end 34 thereof through the windbox chamber 60 to a location near the inlet end 32 of the burner tube 30. Jacket 62 forms a water-cooled annular chamber 64 externally of the burner tube 30. Annular chamber 64 is provided with a pair of horizontal dividers 66 extending along the length thereof to divide the chamber 64 into upper and lower portions. An annular baffle 72 is mounted near the end of chamber 64 to define an end chamber 74 adjacent discharge end 34 of tube 30. Baffle 72 has a large port 76 at its bottom and a smaller port 78 at its top. Cooling water is fed through an inlet fitting 70 into the lower portion of chamber 64 at the inlet end of the burner tube 30 and flows along tube 30 toward the discharge end 34 whereat the water flows through port 76 in baffle 72 into end chamber 74 and upwardly around the discharge end of burner tube 30 in both directions to the upper portion of end chamber 74. The cooling water exits end chamber 74 through port 78 and flows back along the upper portion of chamber 64 until it reaches an outlet fitting 79 through which the cooling water is discharged from the water-cooled annulus. The object of this arrangement is to keep the metal at the tip of the burner tube 30 as cool as possible. To this end, it is important to maintain a high velocity of water flow at this location so as to maximize the heat transfer between the metal and the water. This is achieved by maintaining a high velocity turbulent flow of the cooling water flowing through end chamber 74. By way of example, a flow velocity of seven feet per second is satisfactory for a burner of the type disclosed.

As shown in FIG. 2, the windbox 28 comprises a drum-shaped duct arrangement and a plurality of circumferentially spaced vanes 80 for directing the secondary air into the interior chamber 60 of the windbox 28. The secondary air then swirls and flows outwardly through the windbox opening 82 extending around the primary air-fuel mixture flow to mix therewith in an effective manner and pass into the interior of the furnace. The windbox and vane arrangement is conventional and functions so that the secondary air is distributed evenly around the circumference of the burner tube. To this end, the secondary air enters through a perforated drum 84 extending around the vanes 80 so as to enter the windbox chamber 60 throughout the circumferential extend thereof. In addition, this secondary air has a swirl applied thereto for effective mixing with the primary air-fuel mixture, this swirl being cocurrent with the swirl of the primary air-fuel mixture provided by both the inlet means 36 and diffusion swirler 56.

The center diffuser 40 is provided with an open axial center passage 90 which is supplied with air at its inlet end through a conduit 92. By this arrangement, air passes through the center passage 90 to be discharged at the center of the conical portion 42 of the center diffuser 40 to maintain a small positive flow of air past the inner surfaces of conical portion 42. This prevents eddy currents from recirculating melted fuel back to the inner surface of conical portion 42 and causing coke formation thereat.

A torus-shaped tube 96 extends around the secondary air opening 82 and is provided with openings through which natural gas is injected into the secondary air. Tube 96 is conventional and functions as a natural gas injector for ignition and other heating purposes.

Burner 22 will be provided with a suitable pilot gas supply, spark igniter and other conventional means for starting and maintaining the burner flame. These well-known devices have been omitted from the drawings for the sake of clarity of illustration.

An important operating feature of the burner in accordance with the invention is that the primary air and fuel flow is maintained at all locations throughout the system to be above 95 feet per second. This velocity is measured at the slowest point in the transport system including the supply pipe leading to the burner. To this end, the supply blowers and burner dimensions are such as to maintain this important condition of operation.

Another important operating feature of the burner in accordance with the invention is maintaining an operable exit velocity of the primary air-fuel mixture through the burner orifice 44. This is achieved by taking into account the burner dimensions and the flow conditions of the supply blowers. Exit velocities in the range of 350–400 feet per second were found to be operable in actual tests of burners pursuant to the invention. However, the burner could be operated at much lower exit velocities by making slight modifications in the burner construction (i.e., changing the cone angle, the cone size, the angle of secondary air introduction, etc.). Thus, an exit velocity as low as 125 feet per second could be operative.

It will be apparent that the conditions of operation are somewhat dependent on the size and configuration of the boiler or furnace on which the burner is mounted. The objective is to contain the flame within the furnace length and this can be achieved by varying certain related features of the burner design. For example, by varying the angle of the diffuser conical portion 42 and the amount of the swirl of the primary air-fuel mixture in conjunction with other conditions, it is possible to achieve this desired end.

It is noted that the above-described high flow velocities are contrary to the conventional wisdom. Thus, the prior art suggests that it is not desirable to have a high burner exit velocity because of the energy losses and resultant inefficient operation. However, the burner in accordance with the invention achieves the benefit of being able to burn solvent refined coal without plugging. Also, conventional wisdom suggests that the high transport velocity would create an abrasion problem. However, it was discovered that solvent refined coal, which is easily pulverized to a small size and is a soft material, does not have the abrasion problems of materials such as coal. Moreover, it would seem that the more excess air used the less efficient would be the operation. In the case of coal, both erosion and pressure drop due to high velocity work against the use of higher velocity conditions. However, with solvent refined coal this type of operation has important advantages as discussed above.

In the operation of the burners in accordance with the invention, the cooling water flow, the primary air and pulverized solvent refined coal flow, the secondary air flow, etc. are all maintained under conditions of volume, velocity and temperature so that the exposed exterior surfaces of the burner components are maintained below at least about 150° F. When this temperature condition is maintained, coking and fouling of the burner components by deposits of solvent refined coal is prevented.

While the invention has been described with respect to a specific embodiment, it will be understood that various modifications, alternate constructions and equivalents may be employed without departing from the scope of the invention. For example, while the above-described invention is directed to the firing of pulverized solvent refined coal, the principles of the invention could be applicable to fuels which behave like solvent refined coal. Illustrative of such fuels are heavy bottoms from petroleum refined vacuum towers or bottoms from coke byproduct plants such as coal derived pitch or hydroprocessed solvent refined coal.

We claim:

1. Burner means for the firing of pulverized solvent refined coal fuel or the like comprising:

a burner tube having a fuel inlet end and a discharge end, means for mounting said burner tube on a furnace wall with the discharge end thereof arranged to discharge the solvent refined coal into the furnace chamber for burning thereof, a diffuser centrally located within said burner tube and extending axially along the length thereof to an end location inwardly of and adjacent to said burner tube discharge end, said diffuser and burner tube defining an annular burner passage extending from said fuel inlet end of said burner tube to said discharge end thereof, inlet means for delivering a mixture of primary air and fuel to the fuel inlet end of said burner tube for flow thereof uniformly through said burner passage, said diffuser having an outwardly diverging conical portion at said discharge end for diverting the flow of the primary air-fuel mixture outwardly at an angle to the longitudinal axis of said burner tube, said conical portion extending from a location beyond said discharge end to a location inwardly of said discharge end, said conical portion of said diffuser and said burner tube discharge end defining a single annular burner orifice through which said mixture of primary air and fuel passes, the diameter of said conical portion of said diffuser being such that the cross-sectional area of said annular burner orifice is less than the cross-sectional area of said annular burner passage, said conical portion of said diffuser having an outer diameter at its tip approximately the same as the inner diameter of said burner tube so as to shield the discharge end of said burner tube and the fuel passing therethrough from heat radiation from the burner flame, means for water-cooling said diffuser along the length thereof adjacent said burner tube and at the conical portion thereof, means for supplying a flow of secondary air for mixture with said primary air-fuel mixture, means providing a water-cooled annulus eternally of said burner tube between said burner passage for the primary air-fuel mixture flow and said secondary air flow, and means supplying a mixture of primary air and pulverized solvent refined coal fuel to said inlet means so as to maintain the velocity of said primary air-fuel mixture passing through said burner orifice in the range of about 125–400 ft/sec.

2. Burner means according to claim 1 wherein said primary air-fuel supply means is operated at pressure and flow conditions so that primary air-fuel mixture velocity is maintained to be greater than 95 ft/sec throughout the fuel transport system.

3. Burner means according to claim 2 wherein said inlet means is constructed and arranged to deliver said primary air-fuel mixture tangentially into the fuel inlet end of said burner tube so that said mixture swirls around said burner passage as it flows therethrough.

4. Burner means according to claim 1 wherein said inlet means is constructed and arranged to deliver said primary air-fuel mixture tangentially into the fuel inlet end of said burner tube so that said mixture swirls around said burner passage as it flows therethrough.

5. Burner means according to claim 4 including a diffusion swirler mounted in said burner passage and including vanes oriented at an angle to the burner axis in the direction of flow to cause said primary air-fuel mixture to swirl in a cocurrent direction with said tangential inlet swirl of said mixture.

6. Burner means according to claim 5 wherein said secondary air supply means is constructed and arranged to introduce the secondary air into the furnace in a swirling flow, said swirling flow of said diffusion swirler being cocurrent with said swirling flow of said secondary air.

7. Burner means according to claim 5 wherein said secondary air supply means includes a windbox defining a windbox chamber surrounding said burner tube and having a discharge opening around said discharge end of said burner tube, said watercooled annulus being located between said windbox chamber and said burner passage.

8. Burner means according to claim 5 wherein said diffusion swirler has said vanes thereof arranged at approximately a thirty degree angle to the direction of flow.

9. Burner means according to claim 8 wherein said diffusion swirler is located with its front end about two burner tube diameters back from said conical portion.

10. Burner means according to claim 5 wherein said primary air-fuel supply means is operated at pressure and flow conditions so that the primary air-fuel mixture velocity is maintained to be greater that 95 ft/sec throughout the fuel transport system.

11. Burner means according to claim 1 wherein said conical portion is arranged to divert the flow of the primary air-fuel mixture outwardly of an angle at about thirty degrees to the longitudinal axis of said burner tube.

12. Burner means according to claim 1 wherein said means for water-cooling said diffuser includes a pair of concentric tubes internally of said diffuser forming inner and outer annular passages for the cooling water, one of said concentric tubes having a cone-shaped tip located at said conical portion around which said cooling water flows.

13. Burner means according to claim 1 wherein said water-cooled annulus is provided by a tubular jacket around the exterior of said burner tube and is divided into two flow portions by axially extending dividers.

14. Burner means according to claim 13 including a baffle located in the end of said jacket to define an end chamber adjacent said discharge end of said burner tube, said end chamber having ports therein and providing flow communication between said two flow portions of said water-cooled annulus.

15. Burner means according to claim 14 wherein the cooling water flow through said end chamber is maintained at a high velocity turbulent flow.

16. Burner means according to claim 1 wherein said diffuser includes a central axial passage which at one end terminates at the center of said conical portion, said central axial passage being in communication with means to supply air to said central axial passage to be discharged at the center of said conical portion of said diffuser.

* * * * *